US007726531B2

(12) United States Patent
Barkdoll

(10) Patent No.: US 7,726,531 B2
(45) Date of Patent: Jun. 1, 2010

(54) GONDOLA PEGBOARD COVERING SYSTEM

(75) Inventor: Patrick J. Barkdoll, Pecatonica, IL (US)

(73) Assignee: Southern Imperial, Inc., Rockford, IL (US)

( * ) Notice: Subject to any disclaimer, the term of this patent is extended or adjusted under 35 U.S.C. 154(b) by 796 days.

(21) Appl. No.: 11/436,365

(22) Filed: May 18, 2006

(65) Prior Publication Data

US 2008/0121555 A1 May 29, 2008

(51) Int. Cl.

| | |
|---|---|
| ***B26F 3/00*** | (2006.01) |
| ***B26F 3/02*** | (2006.01) |
| ***B65H 35/00*** | (2006.01) |
| ***B65H 35/10*** | (2006.01) |
| ***A47F 5/08*** | (2006.01) |
| ***A47B 96/06*** | (2006.01) |
| ***E04G 3/00*** | (2006.01) |
| ***B65D 69/00*** | (2006.01) |
| ***B65D 71/00*** | (2006.01) |
| ***G09F 3/00*** | (2006.01) |

(52) U.S. Cl. ..... 225/1; 211/59.1; 248/220.31; 206/575; 40/642.01

(58) Field of Classification Search ..... 211/59.1, 211/54.1, 57.1; 225/1, 2, 6; 248/220.31, 248/220.41, 2.43; 206/575, 459, 460; 40/642.01, 40/667; 83/614; 434/81, 96, 365
See application file for complete search history.

(56) References Cited

U.S. PATENT DOCUMENTS

| | | | | |
|---|---|---|---|---|
| 2,102,977 | A * | 12/1937 | Shoemaker et al. | 248/222.41 |
| 2,295,102 | A * | 9/1942 | Fisher | 283/66.1 |
| 2,775,834 | A * | 1/1957 | Miller, Jr. | 40/624 |
| 3,042,278 | A * | 7/1962 | McCullough | 225/39 |
| 3,083,876 | A * | 4/1963 | Schneider et al. | 222/107 |
| 3,142,426 | A * | 7/1964 | Busse | 225/43 |
| 3,229,875 | A * | 1/1966 | Stoller | 225/38 |
| 3,263,347 | A * | 8/1966 | McCutcheon | 434/430 |
| 3,549,066 | A * | 12/1970 | Wankow | 225/25 |
| 3,799,357 | A * | 3/1974 | Govang | 40/657 |
| 4,244,254 | A * | 1/1981 | Fish | 83/589 |
| 4,307,828 | A * | 12/1981 | Sias et al. | 225/25 |
| 4,378,884 | A * | 4/1983 | Anderson | 206/459.5 |
| 4,989,734 | A * | 2/1991 | Mode et al. | 206/575 |
| 5,392,983 | A * | 2/1995 | Clarke-Bolling et al. | 229/87.19 |
| 5,758,559 | A * | 6/1998 | Capitao et al. | 83/614 |
| 5,884,763 | A * | 3/1999 | Ozawa | 206/397 |
| 6,502,706 | B1 * | 1/2003 | Kent | 211/87.01 |
| 6,612,473 | B1 * | 9/2003 | Newby et al. | 225/48 |
| 7,150,362 | B1 * | 12/2006 | Questiaux et al. | 211/70.6 |

* cited by examiner

*Primary Examiner*—Ghassem Alie
*Assistant Examiner*—Bharat C Patel
(74) *Attorney, Agent, or Firm*—Reinhart Boerner Van Deuren P.C.

(57) ABSTRACT

A method for covering a retail display support structure to alter its appearance is provided. The method first includes the step of dispensing a length of covering material from a wound state on a roll. Next, the length of covering material is severed from roll to form a placard of the covering material having a dimension that corresponds to at least one dimension of the retail display support structure. Next, the placard is secured to retail display support structure to cover at least a portion of the retail display support structure. The placard may be secured to the retail display support structure by pushpins that push through the placard and into holes for supporting peg hooks or shelves.

19 Claims, 7 Drawing Sheets

GONDOLA PEGBOARD COVERING SYSTEM

FIELD OF THE INVENTION

This invention generally relates to merchandise display assemblies and more particularly to methods of maintaining merchandise displays.

BACKGROUND OF THE INVENTION

Shelving units and pegboard display units are the back bone to retail display for displaying merchandise within a retail establishment store. These shelving units typically have a rigid vertical support structure having a plurality of holes for either mounting shelves or peg hooks that support and display the merchandise that is to be sold. Typically, these display units are made from a substantially rigid sheet metal and have a painted finish to provide a clean appearance. In some retail settings, word fiber board pegboard sheets (board sheets with regularly spaced holes) may also be used.

Unfortunately, over time, as the display units are used and merchandise is added and removed from the peg hooks or shelves, the appearance of the display unit degrades as the paint begins to chip or the display units become dirty or rusty. Furthermore, as the display units are typically painted a uniform color, the display units are typically non-descript and provide limited visual appeal. However, during seasonal shopping periods for example such as Christmas, Easter, Halloween, Thanksgiving, and the like, it can be desirable to adjust the appearance of the display units to more accurately represent the shopping period or to provide an indicator as to the type of merchandise that is being sold on the specific display unit. However, repainting the display unit for each shopping season would be very time consuming and expensive.

Thus, there is a need in the art for a quick, easy and/or economical way to modify the appearance of the display unit.

BRIEF SUMMARY OF THE INVENTION

In one aspect, the present invention provides an improved method of maintaining a retail display support structure using roll media. The method includes the steps of dispensing a length of covering material from a wound state on a roll. The dispensed covering material is then severed from the roll to form a placard of covering material. The placard of covering material is sized to correspond to at least one dimension of the retail display support structure. Finally, the placard of covering material is secured to the retail display support structure to cover a portion of the retail display support structure.

In another aspect, the invention provides a kit for covering a retail display support structure with a covering material. The kit including a roll of covering material to cover the product display support. A container carries the roll of covering material. The kit further includes a plastic cutting track mountable to the container. The cutting track includes a first wall, a second wall, and a third wall. The second wall is interposed between the first and third walls to form a cutting groove between the first and second walls and a mounting groove between the second and third walls. The first wall is connected to a first end of the second wall, and the third wall is connected to a second end of the second wall. The first, second and third walls are substantially parallel. The cutting groove is sized for receipt of a cutting blade, and the mounting groove is sized for snug-fit receipt of a wall of the container.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The present invention relates to a method of covering product display structures. As explained previously, the finish of a product display structure can become dirty or damaged over an extended period of use making the display less appealing. Additionally, even with clean and undamaged product display structures, it may be desirable to vary the appearance or decorate the product display structure depending on the products being displayed or the time of year.

Figure 1:
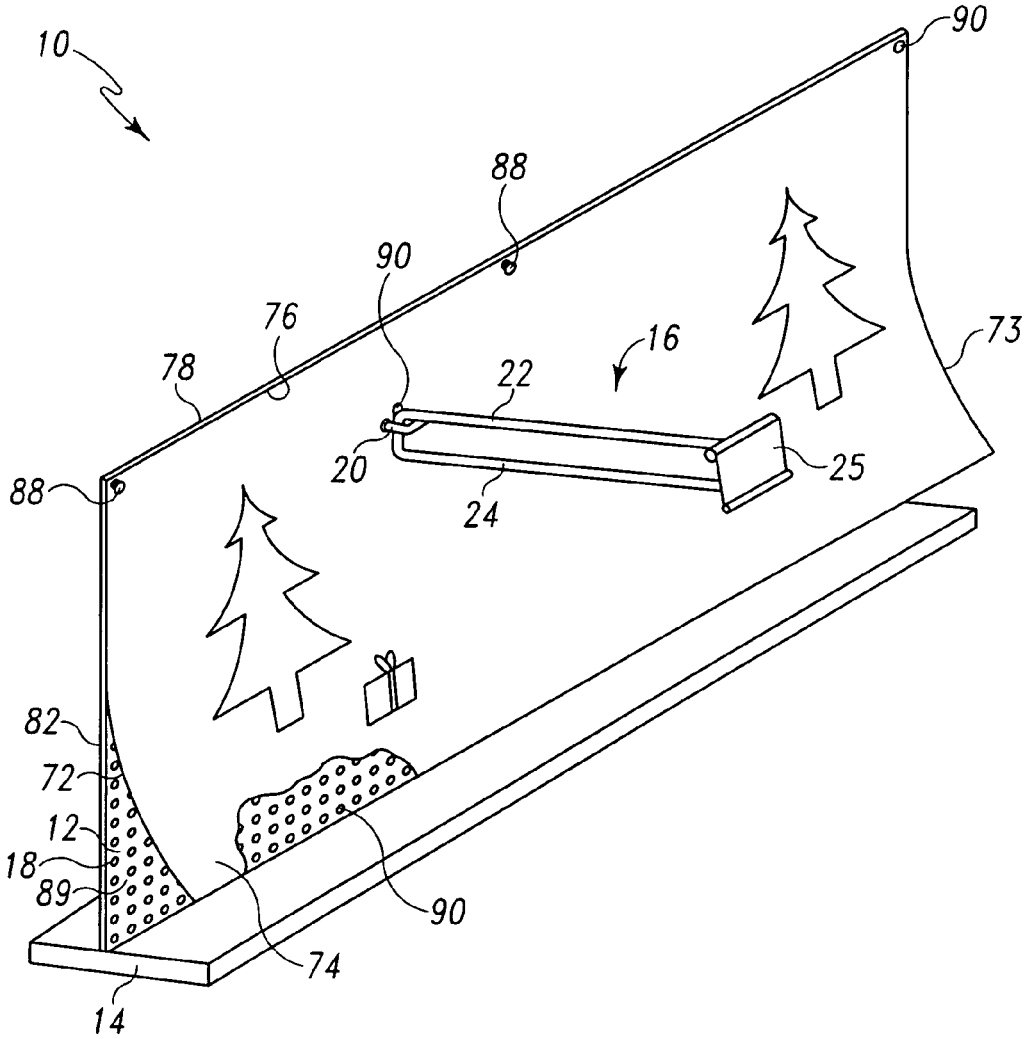
FIG. 1 is a perspective view of a product display structure having a piece of covering material partially attached to the product display structure in accordance with teachings of the present invention.
Figure 2:
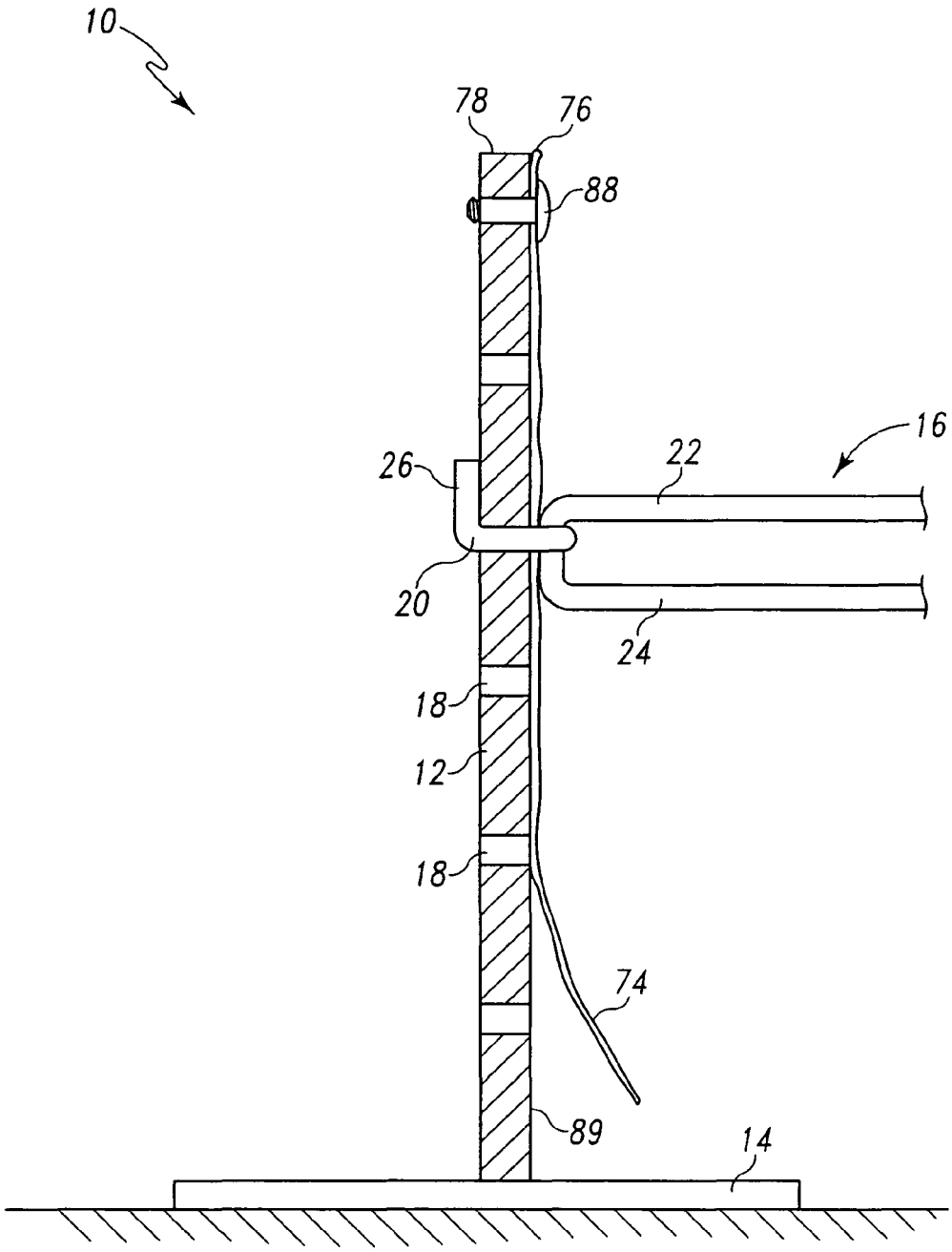
FIG. 2 is a cross-sectional side view of the product display structure and the attached covering material of FIG. 1.

Referring now to the figures, FIGS. 1 and 2 illustrates a product display structure 10 in a simplified manner. The product display structure 10 includes a vertically extending pegboard 12 and a base 14. The base 14 supports the pegboard 12 and prevents the product display structure 10 from tipping or falling. Typically, the base 14 will rest on a floor of the retail establishment. Furthermore, multiple product display structures 10 may be aligned end to end to provide rows or aisles for displaying merchandise.

The pegboard 12 acts as a vertical support structure to which display hooks 16, also known as peg hooks, and other similar hanger devices are mounted for displaying retail product for sale. Horizontal shelving may arranged in front of the pegboard 12. The pegboard 12 includes a plurality of holes 18 for receipt of display hook mounts 20 of the display hook 16. The product display structure 10 is typically made from metal but may be made from any substantially rigid material, such as plastic or wood.

The display hook 16 may be any commercially available display hook. The illustrated display hook 16 is generally U-shaped and includes two horizontally extending bars 22, 24. The two bars 22, 24 are typically formed by bending a generally round rod into the U-shape. The top bar 22 is vertically disposed above the bottom bar 24 and the bars 22, 24 are generally parallel. The top bar 22 supports a label holder 25 and the bottom bar 24 supports retail product (not shown). However, other shaped display hooks may be used such as ones where the two bars are laterally spaced apart or display hooks that only have a single horizontally extending bar. The display hook mounts 20 extend rearward from the horizontal bars 22, 24 and typically have upturned ends 26. The display hook mounts 20 extend through the holes 18 in the pegboard 12. The upturned ends 26 help secure the display hooks 16 to the pegboard 12, and prevent the display hook 16 from being inadvertently removed from the pegboard 12.

As the invention will be described with reference to a pegboard 12 and display hooks 16, the invention is not so limited. The present invention may be applied to other retail product display structures, and typically other retail product display structures having a main support structure with a plurality of holes.

Figure 3:
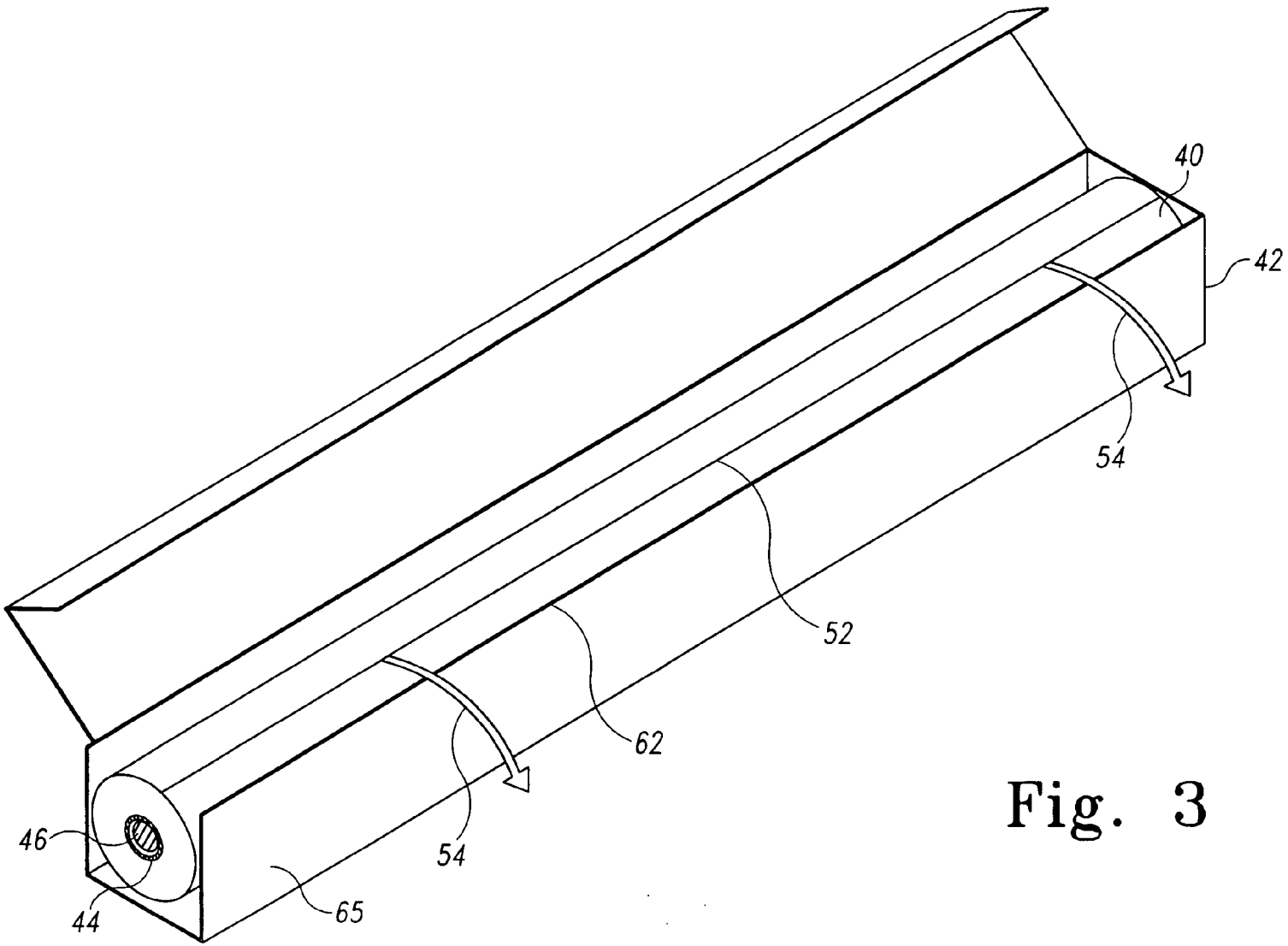
FIG. 3 is a perspective view of a roll of covering material within a container in accordance with the present invention.

As is shown in FIG. 3, a roll of media 40 for covering the product display structure 10 in accordance with the teachings of the present invention is housed in a protective container 42, which may be a box. The roll of media 40 is wound around a hollow center core 44. A spindle 46 attached to ends of the container 46 passes through the center core 44 and mounts the roll of media 40 to the container 42. The spindle 46 is sized smaller than the center core 44 and suspends the roll of media 40 to allow it to easily rotate within the container 42. Rather than utilizing a spindle that extends the entire length of the roll of media 40, the roll of media 40 could be supported by two stub shafts extending inward from and mounted to the ends of the container 42. It is preferable for the media 40 to be mounted on the core 44 and spindle 46 configuration or similar structure for ease of dispensing the media 40; however, the roll of media 40 may merely rest in the container 42. In this configuration, somewhat more force will be required to unroll or dispense the media 40 because of the friction between the container 42 and the media 40.

The rolled format of the media 40 allows very large or long lengths of media 40 to be stored in a compact container 42 and in a protected configuration while making the media 40 easy to handle. As a result, preformed flat placards which are made at a factory and then shipped to a retail establishment need not be done. Rather, the present invention accomplishes major spacing and shipping advantages. The width of the roll of media 40 may be any width, but is preferably between about 2 feet and about 4 feet. The unwound length of the media 40 wound around the center core 44 will preferably be between about 100 and 1000 feet. The unwound linear length of the roll of media 40 can vary depending on the weight of the media and the width of the media. Preferably, the roll of media 40 has a total weight of less than about 20 pounds so that it can be easily manipulated. The container 42 protects the media 40 from environmental conditions such as dust and light. The media 40 is preferably paper or vinyl, but may be any other suitable material for covering the pegboard 12 while providing an aesthetic appearance.

One advantage of vinyl is that it may be washed without degradation to the material. By using a covering material that may be washed, the useful life of the covering material maybe extended between replacement by allowing the covering material to be cleaned if it becomes slightly dirty. However, at some point the appearance of the covering material will become such that it will need to be replaced. In a further embodiment when paper is used, the paper may be coated with a substantially liquid impermeable coating that allows the paper to be washed. This coating is preferably non-reactive to most generally cleaning agents that may include ammonia compounds, bleaches, detergents, soaps and the like.

The present invention provides a method of covering the product display structure 10, i.e. the pegboard 12 with the media 40. The preferred method includes the step of measuring the dimensional size of the area of the pegboard 12 (see FIGS. 1 and 2) to be covered. The measurement may include the height and/or the width of the pegboard 12. Furthermore, one of these dimensions could be doubled if the pegboard 12 were to be covered on both sides with a single piece of media 40.

After measuring, the method includes the step of dispensing a portion of the media 40 from the roll corresponding to the measurements of the area to be covered. The media 40 is dispensed by pulling on the free edge 52 of the roll of media 40, in a direction indicated by arrows 54, causing the roll of media 40 to rotate within the container 42 about the spindle 46. As the roll of media 40 rotates, a portion of the media 40 is unwound from the roll of media 40, as illustrated in FIG. 4.

Figure 4:
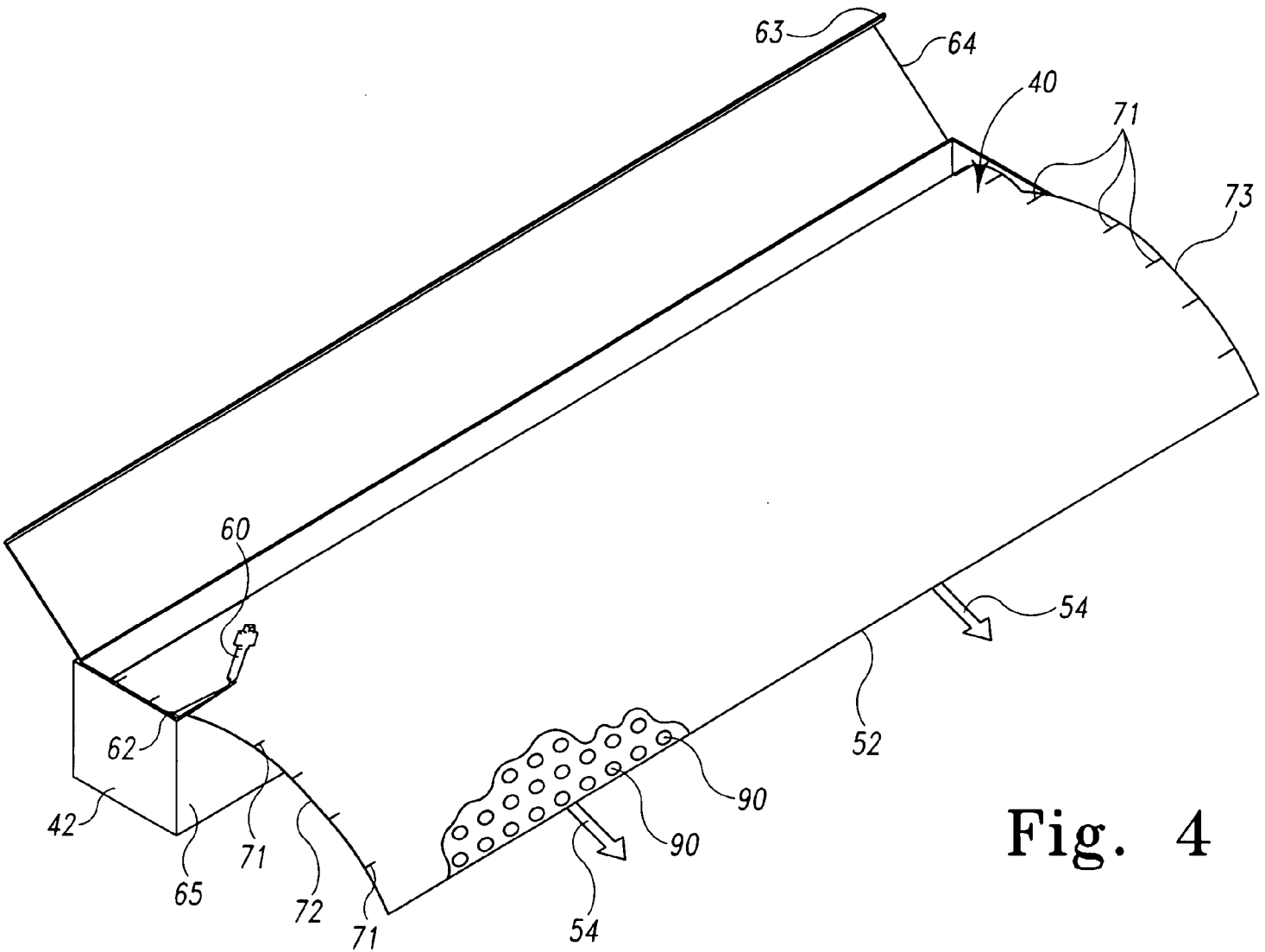
FIG. 4 is a further perspective view of the roll of covering material of FIG. 3 having a portion of the covering material unrolled from the roll.

After a sufficient length of media 40 has been unwound, the unwound length of media 40 is severed from the roll, as is shown in FIG. 4 to form a placard. Length, when used with reference to the media is meant to include the linear amount of media unwound from the roll of media, even if the unwound length of media is shorter than the width of the roll. The step of severing may be performed by cutting with a cutting tool 60, such as is illustrated in FIG. 4 or by tearing, cleaving or like processes. A free edge 62 of the container 42 can be used as a guide to provide a straight edge for making a straight cut. Similarly, the edge 62 can be used to help tear the media and may include a blade secured thereto. Furthermore, the flap 63 of the lid 64 of the container 42 can be inserted behind the media 40 on the inside of the container 42 to secure the media 40 between the flap 63 and the wall 65 of the container 42. This configuration holds and stabilizes the uncut portion of media 40 during severing.

Figure 5A:
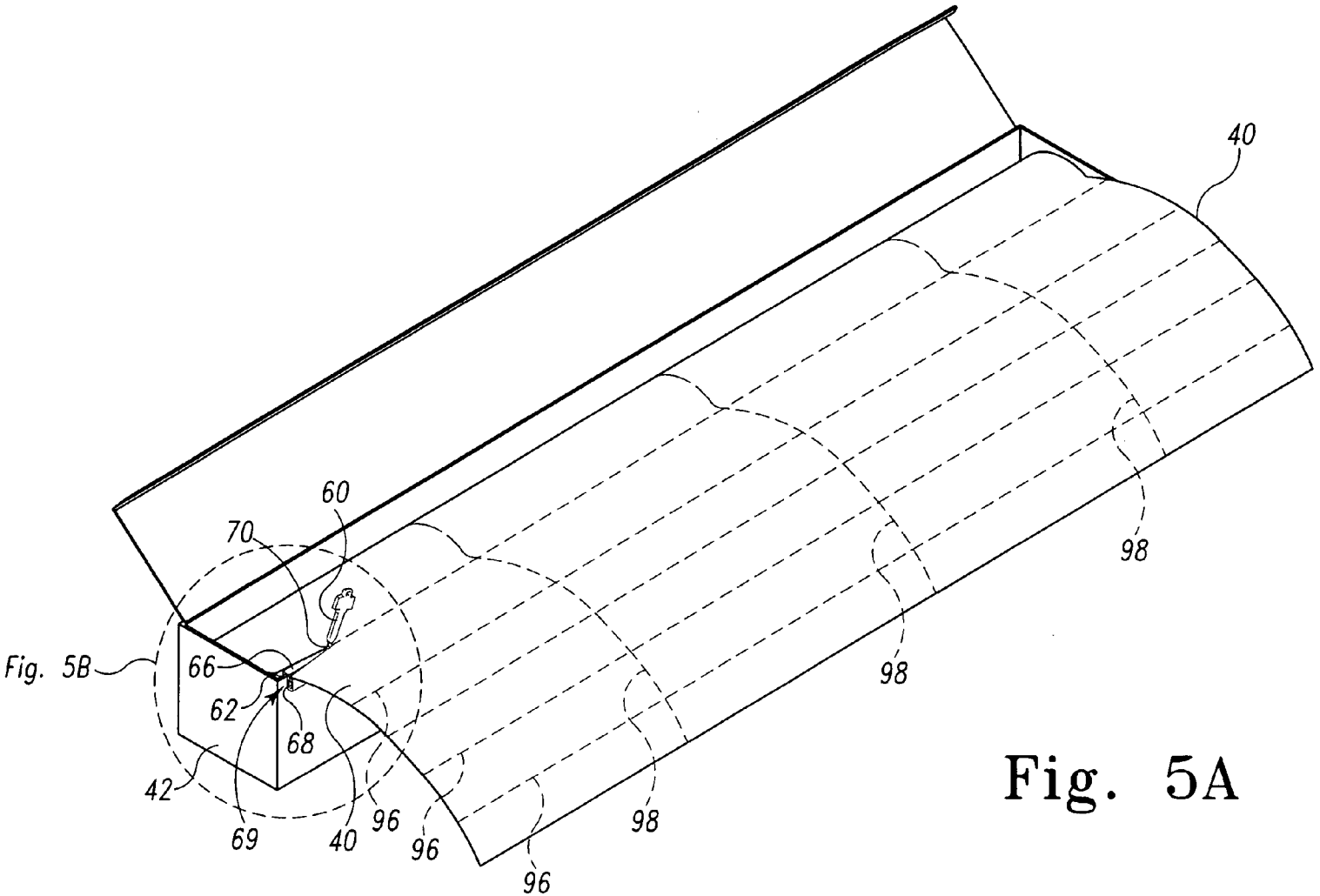
FIG. 5A is a perspective view of an alternative roll of covering material according to the present invention having a portion of the media dispensed from the roll and illustrating a plastic cutting track secured to the free edge of the container.
Figure 5B:
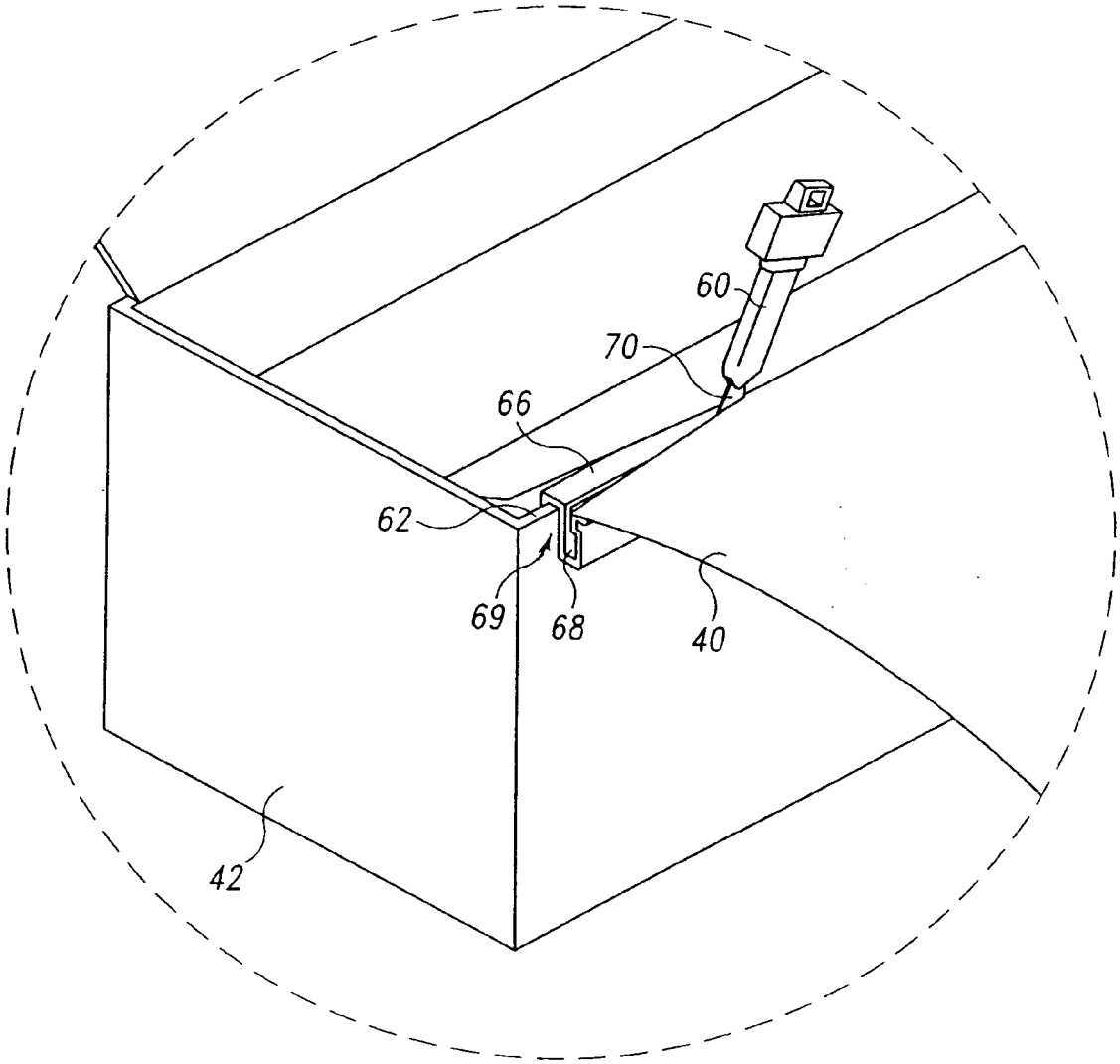
FIG. 5B is an enlarged partial illustration of FIG. 5A more clearly illustrating the cutting track secured to the free edge of the container.

Alternatively, a removable cutting track 66 may be provided that attaches to the free edge 62 of the container 42, as is illustrated in FIGS. 5A and 5B. The cutting track 66 includes a cutting groove 68. When severing the media 40, the position at which the media is to be severed is aligned with the cutting groove 68 and the blade 70 of the cutting tool 60 follows the cutting groove 68. The cutting track 66 provides a safety feature by guarding the blade 70 as the media 40 is severed and further promotes a straight cut of the media 40. The cutting track 66 includes a mounting groove 69 that receives the free edge 62 of the container 42 for mounting the cutting track 66 thereto. As is illustrated, the cutting track 66 is substantially Z-shaped with the cutting groove 68 opening vertically upward and the mounting groove 69 opening vertically downward and the two grooves 68, 69 being separated by a common wall. Preferably, the mounting groove 69 is sized to make a snug fit engagement with the free edge 62 to prevent removal during cutting. The cutting groove 68 is sized larger than the width of the blade 70 but not too large as to provide a significant amount of slop or play when the blade 70 is inserted into the cutting groove 68. It is an aspect of the present invention that the roll of media 40, container 42 and cutting track 66 may be provided as display covering kit.

As illustrated in FIG. 4, the media 40 may include cutting alignment markers 71 proximate the edge 72 of the media 40 for indicating predetermined lengths of media. The cutting alignment markers 71 may also be used to align the media 40 relative to the free edge 62 of the container 42 to further provide a straight cut. Preferably, the cutting alignment markers 71 are evenly spaced apart along the edges 72, 73 of the media 40. Preferably the cutting markers may be spaced apart between about ½" to about 1' depending on the application. If the covering material is typically used for pegboards having a single predetermined standard size, the cutting alignment markers 71 could be spaced apart the predetermined distance for quick and easy determination of how much media 40 to dispense from the roll of media 40. The cutting alignment markers 71 as illustrated only extend a short distance from the edges 72, 73. However, the cutting alignment markers 71 could extend entirely across the media from edge 72 to edge 73. Preferably, the cutting alignment markers 71 are on the side opposite the aesthetic face of the media.

After the length of media 40 is removed from the roll of media 40 forming a placard 74, the placard 74 is secured to the product display structure 10. As is shown in FIG. 1, a free edge 76 of the placard is aligned with a top edge 78 of the pegboard 12. Furthermore, another free edge 72 of the placard 74 is aligned with a vertical edge 82 of the pegboard 12. With the placard 74 aligned with the pegboard 12, the placard 74 is secured to the pegboard 12. A plurality of pushpins 88 are pushed through the placard 74 and through a hole 18 in the pegboard 12 to secure the placard 74. The pushpins 88 seat in the holes 18 and prevent the placard 74 from being removed. In one method, the step of securing requires the pushpin 88 to be pushed through the placard 74 such that the pushpin 88 punctures the placard 74. The pushpins 88 are preferably plastic and more preferably a translucent plastic.

While securing the placard 74 to the pegboard 12, the placard 74 is smoothed across the surface 89 of the pegboard 12 as more and more pushpins 88 are inserted into the placard 74 and pegboard 12. Furthermore, the user may run his finger or hand over the surface of the placard 74 with light pressure to determine the location of the holes 18 in the pegboard 12. The pressure should be light enough that the placard 74 is not significantly pulled causing the portion of media surrounding installed pushpins 88 to tear. Coverage of the pegboard 12 may typically range between 80 and 100 percent of the surface of the pegboard, but it is preferable that substantially all (which term includes but not limited to all) of the pegboard surface be covered by the placard 74.

After the placard 74 is secured to the pegboard 12, the display hook 16 or other hanger devices may be secured to the pegboard 12. Specifically, the upturned ends 26 (see FIG. 2) of the display hook mounts 20 are pushed through and puncture the placard 74 in positions that correspond to the holes 18 of the pegboard 12 and are then inserted through the holes 18 in the pegboard 12 similar to the step of securing the placard 74 with the pushpins 88.

The media 40 may include a plurality of die cut holes 90, as illustrated in FIG. 1. The holes 90 correspond to and are similarly spaced as the holes 18 in the pegboard 12. During the step of aligning the placard 74, the placard 74 will be aligned such that the holes 90 in the placard 74 align with the holes 18 in the pegboard 12. By having the holes 90 precut in the media 40, when the pushpin 88 or the display hook mounts 20 are pushed through the placard 74, the pushpins 88 and display hook mounts 20 do not puncture or tear the placard 74 keeping the edges of the hole 90 through the placard 74 clean and unragged.

Figure 6:
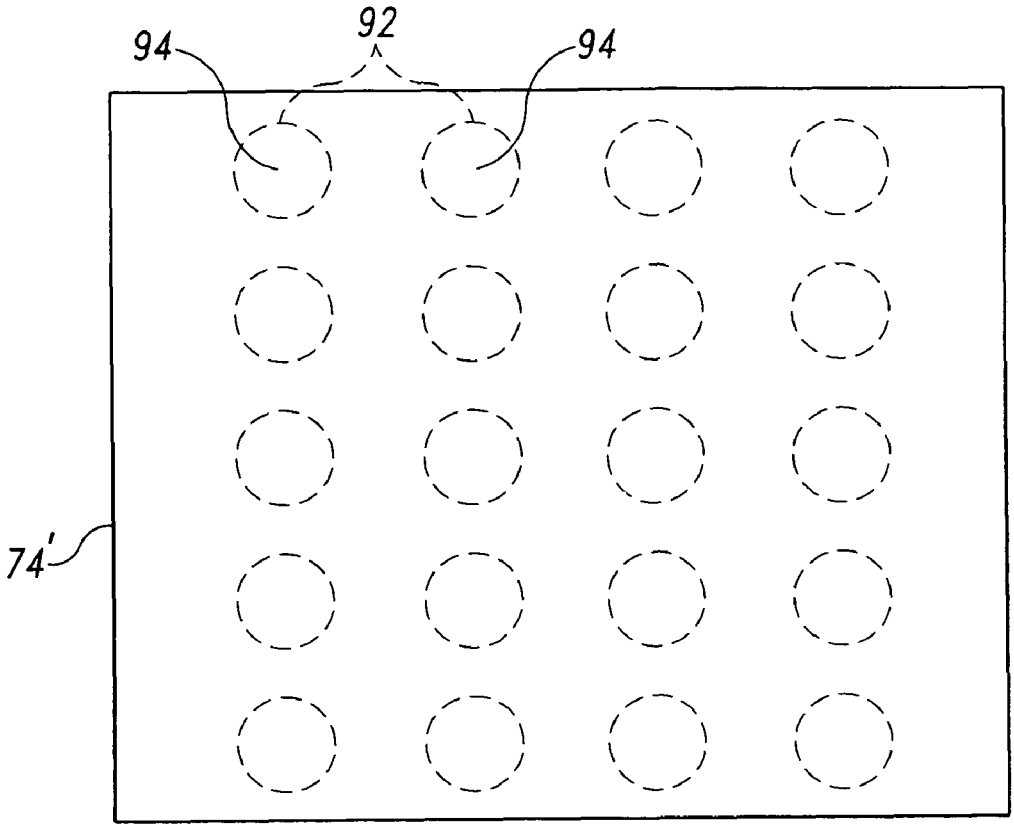
FIG. 6 is a portion of another type of covering material having a plurality of perforated rings in accordance with the teachings of the present invention.

Alternatively, the plug or portion of media that is removed to form the hole 90 in FIG. 3 may not be completely removed from the media. In this embodiment, with reference to FIG. 6, the media may include scored rings 92, illustrated by dashed line circles, outlining a plug 94. The scored rings 92 are precut prior to rolling up the media 40 such as by die cutting preferably into the non-aesthetic side of the media 40. This scored configuration allows for removal of only the individual plugs 94 that need to be removed for insertion of pushpins or display hook mounts but eliminates unnecessary holes which detract from the design and appearance of the placard 74'. Furthermore, using scored rings 92 rather than printed rings allows the plug 94 to more easily removed from the placard 74', thereby, creating a cleaner puncture of the placard 74'. Similar to the die-cut holes, the perforated rings 92 must be spaced apart according to the positions of the holes 18 of the pegboard 12.

Furthermore, the media 40 may include perforated lines 96, 98 running the width of the media 40 and/or the length of the media 40, respectfully, as illustrated in FIG. 5A. These perforated lines 96, 98 could be spaced apart to allow a removed placard of material to be more easily sized to pegboards of various sizes. The perforated lines 98 running the length of the media 40 allow for the width of the media 40 to be easily altered by severing or tearing along these perforated lines 98. The perforated lines 96, 98 may be used for guide lines for cutting the media 40 or be used to provide a more accurate and clean tearing of the media 40. Furthermore, the perforated lines 96, 98 may be used to align a first placard with a second placard if multiple placards are required to completely cover a display structure.

Not only may the covering material come with cutting markers, die-cut holes, scored hole plugs, and perforated lines, the covering material may come in any number of colors, patterns or styles. The ability to provide various patterns allows for decorating the pegboard 12 as can be seen in FIG. 1. By providing various designs, the display structure 10 can be decorated for various times of the year, holidays, events or for the type of product displayed. Thus, in a method according to the present invention may include the step of removing previously installed covering material. For example, when switching a display from displaying Thanksgiving merchandise to displaying Christmas merchandise, the display may have covering material having a Thanksgiving design while the new material may have a Christmas design.

All references, including publications, patent applications, and patents cited herein, are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of covering a retail display support structure for a retail environment at a retail establishment, the retail display support structure including a plurality of holes and adapted to display retail merchandise for resale, the method comprising the steps of:

measuring, at the retail establishment, at least one dimension of the retail display support structure;

dispensing a length of covering material corresponding to the at least one dimension from a wound state on a roll at the retail establishment;

severing the covering material to form a placard of the covering material having a dimension that corresponds to at least one dimension of the retail display support structure;

arranging the placard of covering material over the retail display structure;

securing the placard of covering material to the retail display support structure to cover at least a portion of the retail display support structure;

pushing a plurality of pins through the covering material and into a corresponding plurality of holes in the retail display support structure;

wherein:

the covering material includes generally annular scored plugs, wherein the annular scored plugs exist on the covering material in the wound state on the roll, at least some of the annular scored plugs having an arrangement corresponding to a plurality of holes of the retail display support structure; and further comprising:

punching out one or more of the annular scored plugs at the retail establishment to form one or more receiver holes through the placard;

aligning the one or more receiver holes with corresponding holes in the retail display structure; and inserting one or more of the pushpins through the receiver holes.

2. The method of claim 1:

wherein the covering material has an aesthetic face on one side and measurement lines on a second side, the measurement lines being arranged at spaced intervals; and using said measurement lines to assist in corresponding the dimension of the placard with the at least one dimension of the retail display structure.

3. The method of claim 2, wherein the measurement lines are defined by perforated lines at spaced intervals.

4. The method of claim 3, further comprising tearing the covering material along at least one of the perforated measurement lines.

5. The method of claim 2, wherein the measurement lines are light colored lines on the second side.

6. The method of claim 1, wherein the covering material is vinyl.

7. The method of claim 1, wherein the covering material is paper.

8. The method of claim 7, wherein the paper covering material includes a washable coating.

9. The method of claim 1, wherein the placard does not cover all of the visible surface of the retail display support structure; and further comprising measuring at least one dimension of the remaining uncovered retail display support structure, dispensing and severing covering material from the roll according to the at least one dimension of the uncovered retail display support structure to form a second placard of covering material, wherein the second placard has different dimensions than the original placard, and further comprising securing the second placard to the retail display support structure to cover substantially all of the visible surface of the retail display support structure.

10. The method of claim 1, wherein the covering material has a plurality of preformed holes, at least some of the preformed holes having an arrangement corresponding to the plurality of holes of the retail display support structure, and wherein the step of securing the covering material requires aligning the at least some of the preformed holes of the covering material with selected holes in the retail display support structure; and further comprising installing a pin through a corresponding aligned hole in the covering material and the retail display support structure.

11. The method of claim 1, wherein the step of severing the covering material includes cutting the material from the roll of covering material.

12. The method of claim 11, wherein cutting includes aligning a desired location of the covering material to be cut with the edge of a container in which the roll is stored to guide the cutting of the covering material.

13. The method of claim 11, further comprising the step of aligning a desired location to be cut with a cutting groove of a cutting track attached to a free edge of a container in which the roll is stored, and cutting the covering material with a cutting tool having a cutting blade by guiding the cutting blade by the cutting groove of the cutting track.

14. The method of claim 1, further comprising:

matching, at the retail establishment, the dimensions of the placard to a pegboard of the retail display support structure wherein the placard covers at least 80 percent of the visible surface of the pegboard of the retail display support structure.

15. The method of claim 1, further comprising:

matching, at the retail establishment, the dimensions of the placard to a pegboard of the retail display support structure wherein the placard covers substantially all of the visible surface of the pegboard of the retail display support structure.

16. The method of claim 1, further comprising:

severing the covering material along perforated lines in the covering material extending in a direction perpendicular to a rotational axis of the roll of covering material.

17. The method of claim 1, further including the step of removing old covering material from the retail display support structure prior to the step of securing the placard to the retail display support structure.

18. The method of claim 1, further comprising repeating the steps of claim 1 for a second retail display support structure, wherein the second retail display support structure has at least one dimension different than the first retail display support structure, and a second placard for the second retail display support structure has at least one dimension different than the first placard.

19. A method of covering a retail display support structure for a retail environment at a retail establishment, the retail display support structure including a plurality of holes and adapted to display retail merchandise for resale, the method comprising the steps of:

measuring, at the retail establishment, at least one dimension of the retail display support structure;

dispensing a length of the covering material from a wound state on a roll at the retail establishment;

wherein dispensing a length of the covering material further comprises matching, at the retail establishment, the dimensions of the placard to a pegboard of the retail display support structure wherein the placard covers at least 80 percent of the visible surface of the pegboard of the retail display support structure, wherein matching the dimensions of the placard to a pegboard of the retail display support structure is such that the placard covers substantially all of the visible surface of the pegboard of the retail display support structure;

severing the covering material to form a placard of the covering material having a dimension that corresponds to at least one dimension of the retail display support structure;

wherein the step of severing the covering material includes cutting the material from the roll of covering material;

wherein the step of cutting includes aligning a desired location of the covering material to be cut with the edge of a container in which the roll is stored to guide the cutting of the covering material;

further comprising the step of aligning a desired location to be cut with a cutting groove of a cutting track attached to a free edge of a container in which the roll is stored, and cutting the covering material with a cutting tool having a cutting blade by guiding the cutting blade by the cutting groove of the cutting track;

arranging the placard of covering material over the retail display structure;

wherein the covering material has preformed holes, the preformed holes being in the form of generally annular scored plugs whereby the annular scored plugs exist on the covering material in the wound state on the roll, at least some of the annular scored plugs having an arrangement corresponding to a plurality of holes of the retail display support structure;

securing the placard of covering material to the retail display support structure to cover at least a portion of the retail display support structure;

wherein securing the placard includes pushing a plurality of pins through the covering material and into a corresponding plurality of holes in the retail display support structure, which includes:

punching out one or more of the annular scored plugs defining the preformed holes to form one or more receiver holes through the placard;

aligning the one or more receiver holes with corresponding holes in the retail display structure; and inserting one or more of the pushpins through the receiver holes;

wherein the covering material has an aesthetic face on one side and measurement lines on a second side, the measurement lines being arranged at spaced intervals;

using said measurement lines to assist in corresponding the dimension of the placard with the at least one dimension of the retail display structure;

wherein the covering material has perforations and the covering material has light colored lines on the second side to form said measurement lines at spaced intervals;

wherein severing the covering material includes severing the covering material along the perforated lines in the covering material extending in a direction perpendicular to a rotational axis of the roll of covering material;

wherein the covering material is paper;

wherein the paper covering material includes a washable coating;

further including the step of removing old covering material from the retail display support structure prior to the step of securing the placard to the retail display support structure; and further comprising dispensing and severing covering material from the roll to form a second placard of covering material, and further comprising securing the second placard to the retail display support structure.

* * * * *